US007609215B2

(12) United States Patent
Apostolos

(10) Patent No.: US 7,609,215 B2
(45) Date of Patent: Oct. 27, 2009

(54) VEHICULAR MULTIBAND ANTENNA

(75) Inventor: John T. Apostolos, Lyndeborough, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 11/783,824

(22) Filed: Apr. 12, 2007

(65) Prior Publication Data

US 2008/0158083 A1 Jul. 3, 2008

Related U.S. Application Data

(63) Continuation-in-part of application No. 11/641,045, filed on Dec. 19, 2006.

(51) Int. Cl.
*H01Q 1/32* (2006.01)
*H01Q 9/04* (2006.01)
*H01Q 9/16* (2006.01)

(52) U.S. Cl. ..... 343/711; 343/791; 343/793

(58) Field of Classification Search ..... 343/711, 343/790, 791, 793, 858, 895
See application file for complete search history.

(56) References Cited

U.S. PATENT DOCUMENTS 4,149,170 A * 4/1979 Campbell et al. ..... 343/885
4,940,989 A * 7/1990 Austin ..... 343/749
5,790,080 A 8/1998 Apostolos
6,181,292 B1 1/2001 Dobrovolny
6,313,716 B1 11/2001 Apostolos
6,323,814 B1 11/2001 Apostolos
6,373,440 B2 4/2002 Apostolos
6,373,446 B2 4/2002 Apostolos
6,404,391 B1 6/2002 Apostolos
6,480,158 B2 11/2002 Apostolos
6,492,953 B2 12/2002 Apostolos
6,504,508 B2 1/2003 Apostolos
6,590,593 B1 7/2003 Robertson et al.
6,774,745 B2 8/2004 Apostolos
6,791,502 B2 9/2004 Apostolos et al.
6,839,038 B2 * 1/2005 Weinstein ..... 343/795
6,894,656 B2 5/2005 Apostolos et al.
6,963,313 B2 * 11/2005 Du ..... 343/790
6,985,121 B1 1/2006 Bogdans et al.
6,999,037 B2 2/2006 Apostolos
7,053,850 B1 5/2006 Bogdans et al.
7,053,851 B1 5/2006 Bogdans et al.
7,164,389 B1 1/2007 Platt
7,180,460 B1 2/2007 Bogdans et al.

* cited by examiner

*Primary Examiner*—Shih-Chao Chen
(74) *Attorney, Agent, or Firm*—Bingham McCutchen LLP; Robert C. Bertin

(57) ABSTRACT

A coaxial antenna is implemented that combines a VHF and UHF antenna on a common radiating element. The antenna may further include a satellite antenna that, together with the VHF/UHF antenna fits into a whip antenna footprint. The antenna incorporates chokes that may be implemented using meanderline techniques.

23 Claims, 10 Drawing Sheets

VEHICULAR MULTIBAND ANTENNA

CROSS REFERENCE TO RELATED APPLICATIONS

This patent application is related to a co-pending patent application filed on Dec. 19, 2006, U.S. patent application Ser. No. 11/641,041, having the title "Vehicular Multiband Antenna" and the applicant John T. Apostolos. This application claims priority to, and is a continuation in part of, U.S. patent application Ser. No. 11/641,045 filed on Dec. 19, 2006, and entitled, "Vehicular Multiband Antenna."

STATEMENT OF GOVERNMENT INTEREST

The invention claimed in this patent application was made with U.S. Government support under contract no. W56HZV-05-C-0724 awarded by the US Army. The U.S. Government has certain rights in the invention.

FIELD OF THE INVENTION

The present invention relates generally to antennas and, more particularly, to a compact antenna that is capable of transmitting and receiving signals in multiple bands and of being mounted on a vehicle to facilitate communications.

BACKGROUND OF THE INVENTION

Communication antennas, including communications antennas for vehicles, are generally adapted to receive and/or transmit and receive signals in a particular frequency range. The antennas are sized and configured in order to optimize efficiency at particular frequency ranges.

VHF, UHF and satellite antennas have conventionally been implemented in separate antenna structures. For example, receiving satellite antennas have generally been implemented with a dish type antenna structure while VHF and UHF antennas have generally been implemented as monopole or dipole antennas and sometimes as dipole array structures. UHF antennas have also been implemented as dish antennas. To miniaturize the size of antennas, meander line loaded antennas are known and are exemplified by U.S. Pat. Nos. 5,790,080; 6,323,814; 6,373,440; 6,373,446; 6,480,158; 6,492,953; 6,404,391 and 6,590,593, assigned to the assignee hereof and incorporated herein by reference. However, notwithstanding various antenna design techniques, conventional, VHF and UHF and satellite antennas have generally not been combined into a single antenna structure.

For example, military, law enforcement and even commercial vehicles may be required to be equipped with communications devices to permit operators to exchange information with a variety of different information services, command and control or dispatch centers, GPS and other information. Therefore, it is not uncommon for such vehicles to include multiple, separate antennas, each designed to communicate efficiently at a particular frequency range or a few frequency ranges.

There is a need, however, for an antenna that is capable of transmitting in the VHF, UHF and satellite frequency ranges using a shared radiating element. There is a further need for a combined antenna to assume a standard footprint, such as a co-axial whip antenna, that may be implemented and fitted onto existing vehicles. There is still a further need for a combined antenna capable of efficient operation in the following four frequency bands: 30-88 MHz, 108-156 MHz, 225-450 MHz and 1350-1550 and 1650-1850 MHz that fits into the form factor of a 30-88 MHz whip antenna.

SUMMARY OF THE INVENTION

According to the present invention, a coaxial antenna is implemented that combines a VHF and UHF antenna on a common radiating element. The antenna may further include a satellite antenna that, together with the VHF/UHF antenna fits into a whip antenna footprint. The antenna incorporates chokes that may be segment radiating elements at different frequency ranges to allow at least one common antenna feed point but multiple frequency operation. in addition, the chokes may be implemented using meanderline techniques.

According to one embodiment of the invention, a coaxial antenna capable of operating in at least two different frequency ranges includes radiating elements and chokes. The radiating elements are capable of operating in a first frequency range of interest and the chokes limit the operating efficiency of at least portions of the radiating elements at the second frequency range. The choked portions of the radiating elements are not excited efficiently at the second frequency range of interest and therefore create two different effective antenna configurations for the different frequency ranges handled by the antenna. The first frequency range may be lower than or greater than the second frequency range. Embodiments of antennas according to the present invention may include transmitting antennas, receiving antennas or antennas that transmit and receive signals.

According to additional embodiments of the present invention, communication with the antenna at the first and second frequency ranges may occur through a common conductor and the common conductor may form at least part of the radiating elements capable of operating at the first and second frequency ranges. In addition the common conductor may be a shielded conductor, such as a coaxial cable. The first and second frequency ranges may comprise frequency ranges in the UHF and VHF frequency bands, respectively.

According to still other embodiments of the invention, the antenna may further include a second conductor capable of carrying a third frequency range. In this configuration, the common conductor and second conductor may enter the base of the antenna and the second conductor may be coupled to an antenna element, which may be a satellite antenna, at the top end of the antenna for operation in the third (and even additional) frequency ranges. The third frequency range may include a L band frequency range or other frequency ranges, including those used for satellite communication.

According to one embodiment of the invention, an antenna according to the present invention is configured to have similar overall dimensions as the Army's AS3900A whip antenna and operate at 30-88 MHz and 108-156 MHz in the first frequency range; 225-450 MHz in the second frequency range; and 1350-1550 and 1650-1850 MHz in the third frequency range.

BRIEF DESCRIPTION OF THE FIGURES

The above described features and advantages of the present invention will be more fully appreciated with reference to the accompanying detailed description and figures, in which.

DETAILED DESCRIPTION

According to the present invention, a coaxial antenna is implemented that combines a VHF and UHF antenna on a common radiating element. The antenna may further include a satellite antenna that, together with the VHF/UHF antenna fits into a whip antenna footprint. The antenna uses a common feed for the UHF/VHF antenna and a separate feed for the satellite antenna.

Figure 1:
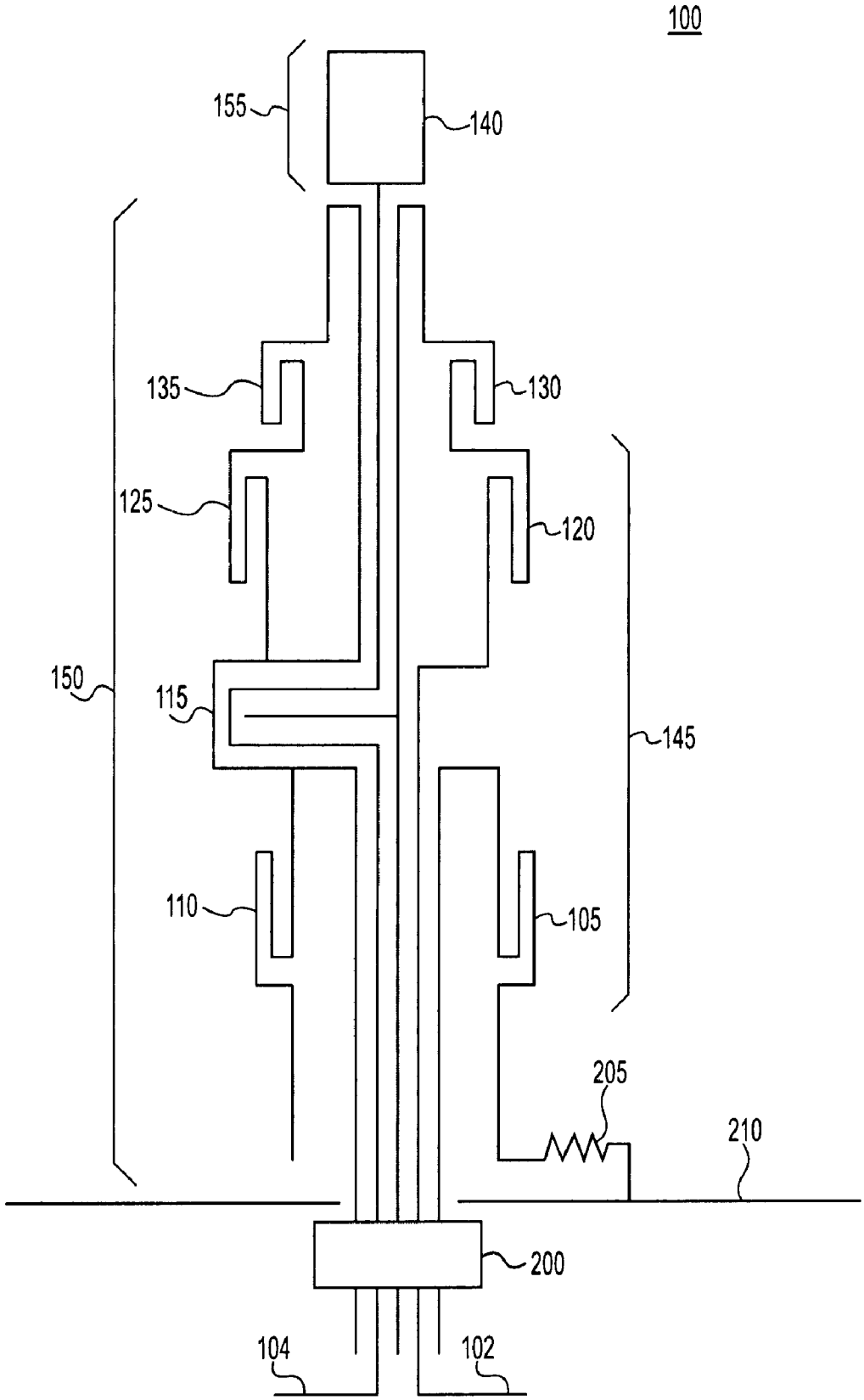
FIG. 1 depicts a coaxial antenna for multi band operation according to an embodiment of the present invention.

FIG. 1 depicts an electrical cross section of electrical elements within an antenna 100 according to an embodiment of the present invention. Referring to FIG. 1, the antenna 100 is a co-axial antenna that that may be suited to a variety of uses, including mounting on a vehicle or a structure. The antenna 100 may be elongated and fit within a whip antenna footprint. In addition, according to one embodiment of the invention, the antenna 100 may be a whip antenna of approximately 96 inches in length and be footprint compatible with the vehicular antenna designated ASS3900A by the U.S. Army. In such a configuration, the antenna may operate in four bands, and specifically 30-88 MHz, 108-156 MHz, 225-450 MHz and 1350-1550, 1650-1850 MHz. It will be understood that this preferred configuration is only one implementation of a multi-band antenna according to the present invention, and that other frequencies of operation and footprints may be implemented according to the description and considerations provided herein.

Referring to FIG. 1, the antenna 100 has three sections and a feed at its base: a satellite antenna section 155, a VHF section 150 and a UHF section 145. The antenna is fed at its base by a UHF/VHF feed 102 and a satellite feed 104. The satellite section 155 includes a satellite antenna 140. The satellite antenna 140 is generally positioned at the top of the antenna structure to facilitate extra terrestrial communication. The satellite antenna may be any convenient type or size satellite antenna depending on the application, frequencies of interest, footprint and other antenna requirements. The satellite may include, for example, a dish antenna, a quadrifiler helix antenna or asymmetric dipole antenna, among others. According to one embodiment of the invention, the satellite antenna is a L band satellite antenna that operates in the frequency ranges 1350-1550 and 1650-1850 MHz.

The satellite antenna 140 is fed through the antenna structure by the L band satellite feed 104. The feed 104 traverses the length of the antenna structure 100 from its base to the satellite antenna 104. According to one embodiment of the invention, the feed comprises a transmission line, such as a coaxial cable or other shielded conductor, that passes through the UHF/VHF feed 102 by rotation around a ferrite loaded coil 200. This coil may be used to resonate the VHF portion of the antenna at low end frequencies. The shields of the L-band and VHF/UHF conductors may be coupled together along their length and are electrically coupled to the lower portions of the UHF/VHF antenna structure portions 145 and 150.

The lower VHF/UHF antenna portions 145 and 150, according to one embodiment of the invention, are coupled at one end to the shields and may be coupled at the other end to a ground plane 210, through a resistive element, for example through a 50 ohm shunt resistor 205. However, it will be understood that other values may be used. In general, the shunt resistor, together with other elements of the antenna structure, provides a distributed loss function at lower frequencies.

The upper portions of the VHF/UHF antenna structure and the 145 and 150 are coupled to the central conductor of the VHF/UHF feed. This central conductor carries a multiplexed VHF/UHF signal that is received via the antenna or that is fed to the antenna for transmission over the VHF/UHF feed. In this configuration, the VHF antenna comprises a centrally fed coaxial antenna that has an electrical length represented by the length of the portion 150. At the same time, the UHF portion of the combined antenna structure is implemented along a portion of the length of the VHF antenna, namely the portions identified as 145. The VHF antenna structure includes along its electrical length chokes 105, 110; 120, 125 and 130, 135. The chokes may be implemented in any convenient manner. According to one embodiment of the invention, the chokes may be implemented as cylindrical versions of strip meanderline transmission lines with high and low impedance sections. In this embodiment, the coaxial chokes are cylinders of revolution of the meanderline structure seen in the cross section of FIG. 1. Other examples of chokes include strip meanderlines and coaxial meanderlines. The chokes are used to allow lower frequency VHF signals to propagate along the full length of the antenna structure between the base and the chokes 130, 135 while the UHF signals are confined to the portion between 105 and 120. The chokes are pictured as appearing on the left and right side of the antenna structure. However, it will be understood that due to the coaxial nature of the antenna, chokes 105 and 110 (and the other choke pairs as shown) may be implemented as a single choke in this configuration.

Figure 2:
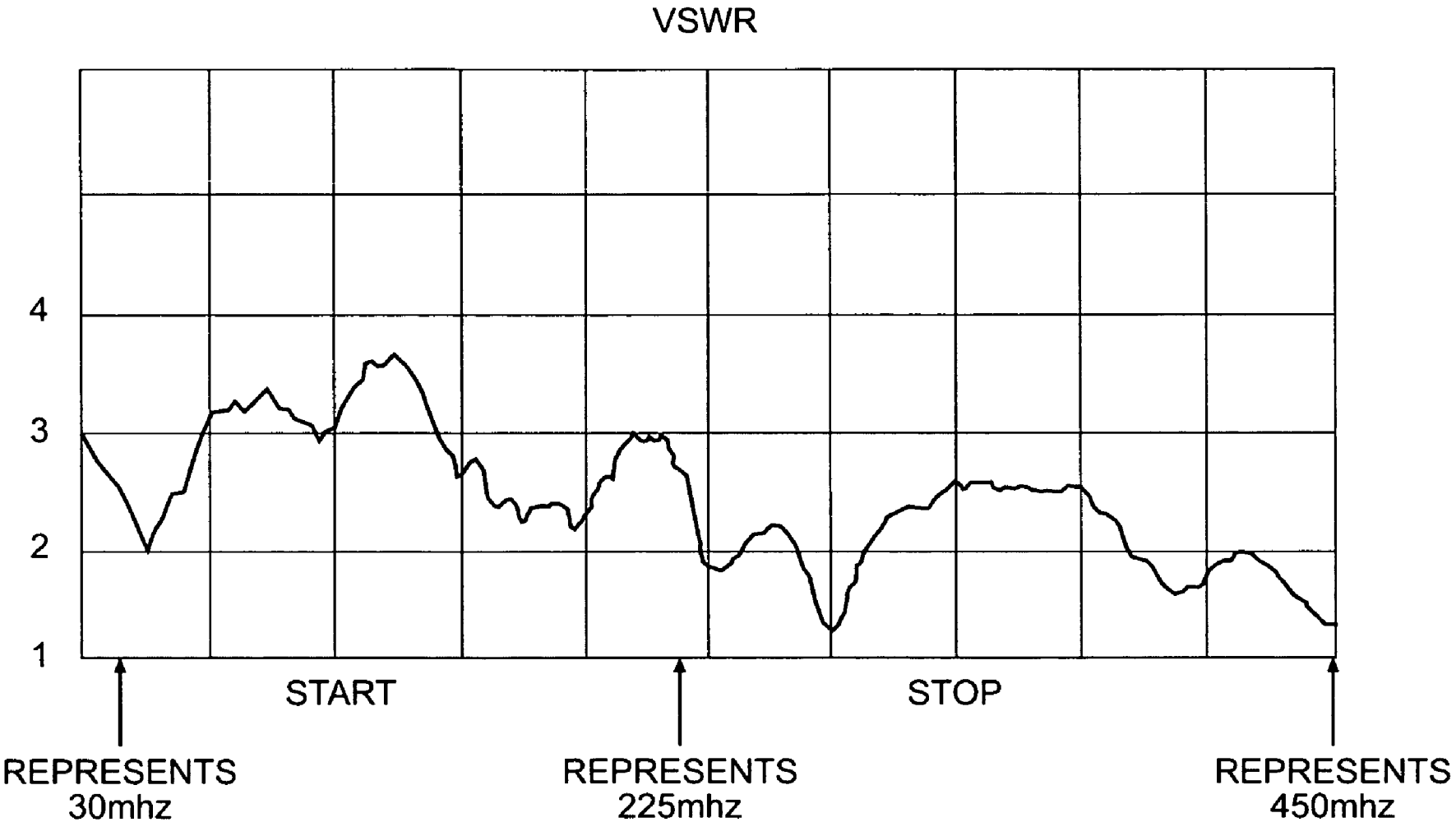
FIG. 2 depicts an illustrative voltage standing wave ratio (VSWR) pattern for a half size model of an antenna as shown in FIG. 1.

FIG. 2 depicts an illustrative voltage standing wave ratio (VSWR) pattern for a half size model of an antenna as shown in FIG. 1. The illustrative graph depicts VSWR taken at frequencies from 60 to 900 MHz. The frequency axes were scaled by ½ to show what the performance would be in the 30 to 450 MHz range. The half size model has a total length of 48 inches (diameter 0.625) and the UHF/VHF section is 42 inches (diameter 0.625). The full size model has a total length of 96 inches (diameter 1.25) and the UHF/VHF section is 84 inches (diameter 1.25). The VSWR of the antenna shows a variation in the VSWR of between 2.5 to about 1.5 between 30 MHz and 450 MHz.

A ferrite element 200 may be implemented at the base of the antenna so that the VHF/UHF conductors and the L-band conductors are would around the base. The base (not shown) is generally used for mounting and to facilitate making electrical connection to the ground plane and to the VHF/UHF and L-band feeds.

According to one embodiment of the invention, the full length of the multi band antenna is utilized for frequencies less than 160 MHz. Losses in the chokes, together with losses in the ferrite elements shown and the resistive element results in diminished efficiency at low frequencies. The efficiency of the VHF antenna at 30 MHz is about 25% and the total length of the multi-band antenna, from the base to the L band antenna is approximately 96 inches.

Figure 3:
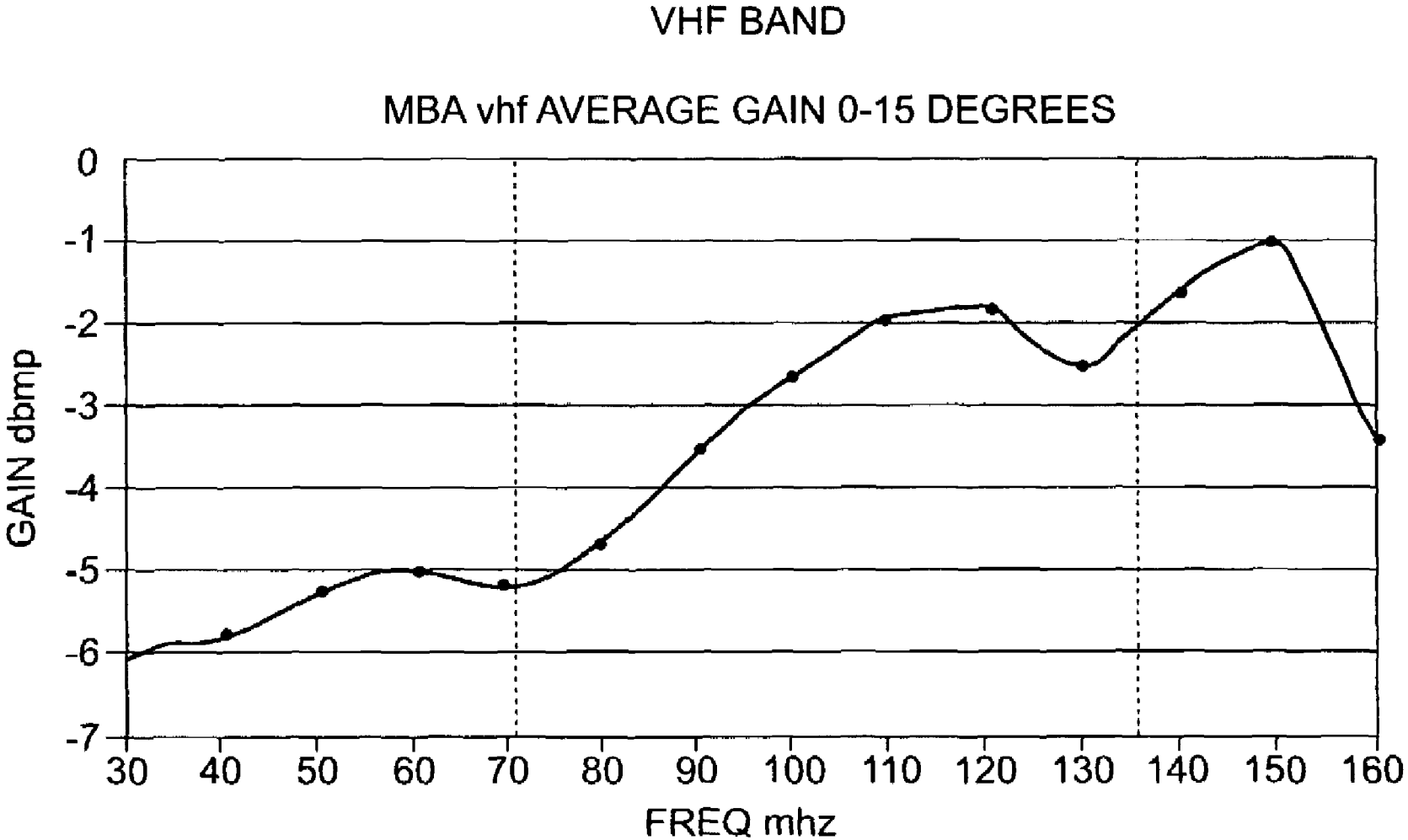
FIG. 3 depicts an illustrative graph the peak measured gain from 0 to 15 degrees of elevation angle in the VHF band.
Figure 4:
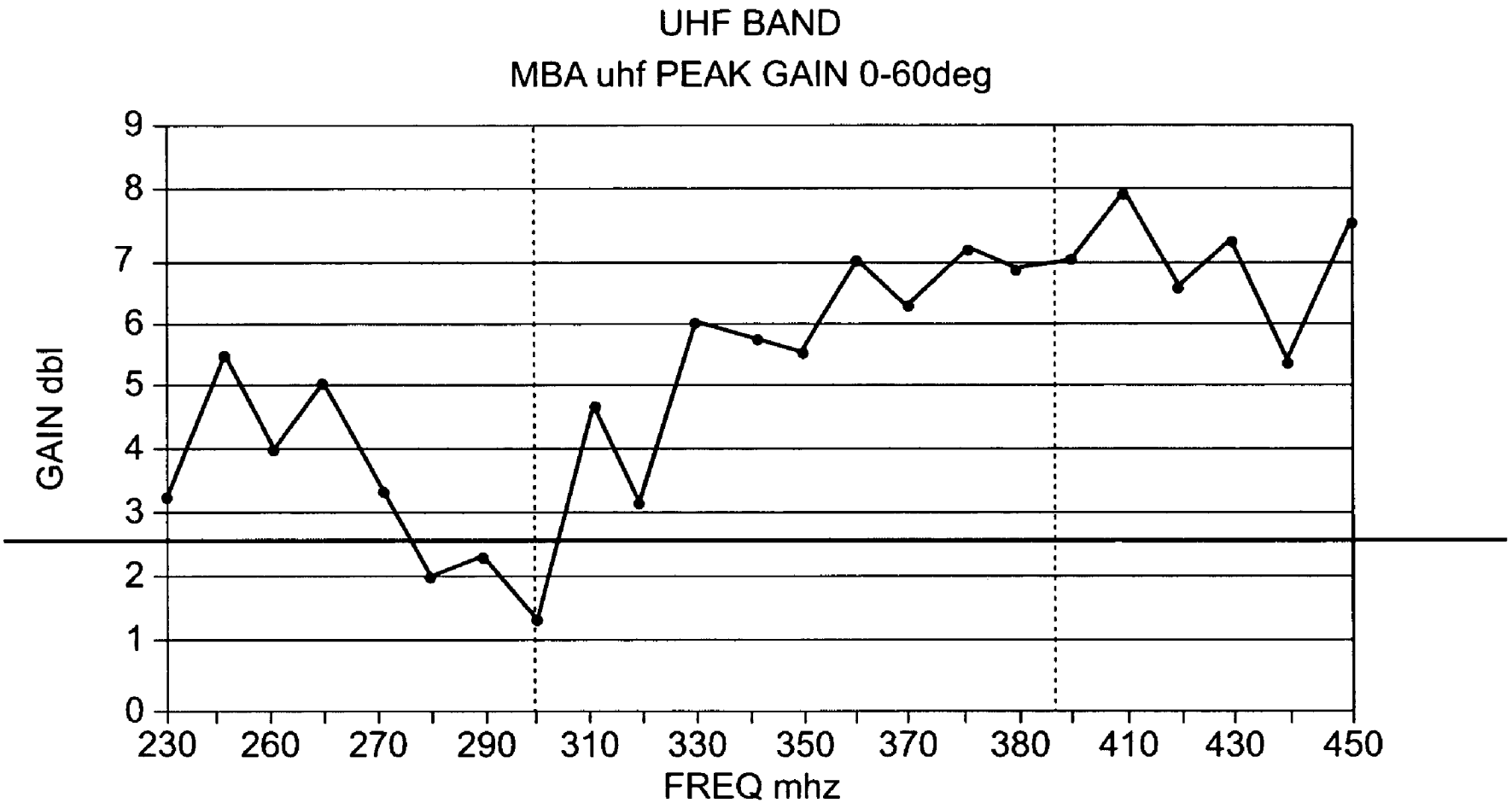
FIG. 4 depicts an illustrative graph of the peak measured gain from 0 to 70 degrees of elevation angle in the UHF band.
Figure 5A:
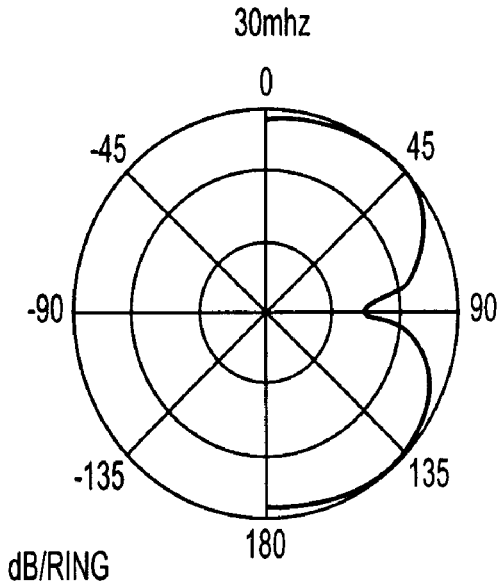
FIGS. 5*a*-5*d* depict illustrative elevation patterns over the VHF/UHF bands at frequencies of 30 MHz, 160 MHz, 300 MHz and 450 MHz respectively. These graphs generally depict good elevation coverage from 0 to 180 degrees, with notches in the gain around 90 degrees.
Figure 5B:
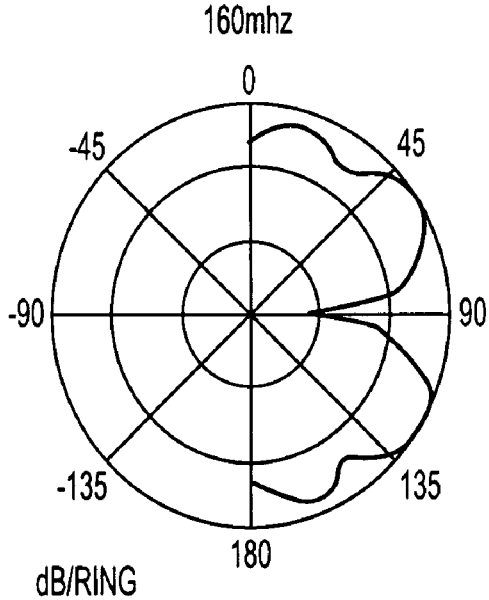
Figure 5C:
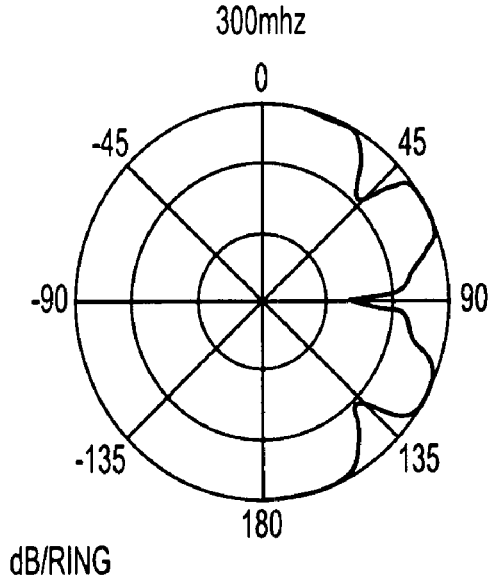
Figure 5D:
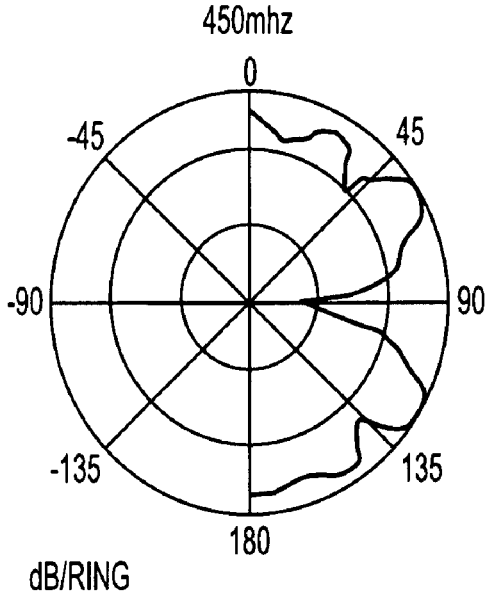

FIGS. 3-5 depict illustrative graphs of the antenna configured over a 10 foot by 10 foot ground plane. All of the frequencies in the graphs are scaled by ½. The data was actually taken from 60 to 320 MHz for VHF and 460 to 900 MHz for UHF. FIG. 3 depicts an illustrative graph the peak measured gain from 0 to 15 degrees of elevation angle in the VHF band. Referring to FIG. 3, the peak antenna gain over the range from 0 to 15 degrees ranges from −6 dbmp to −2 dbmp at 150 Mhz. The gain drops to about −4 dbmp at 160 MHz.

FIG. 4 depicts an illustrative graph of the peak measured gain from 0 to 60 degrees of elevation angle in the UHF band. Because of the size of the grand plane and the height of the active UHF portion of the antenna, there are lobes in the elevation pattern with 3-6 db of extra gain over that in free space. Referring to FIG. 4, the peak gain appears around 410 MHz and the low at 310 MHz.

FIGS. 5*a*-5*d* depict illustrative elevation patterns over the VHF/UHF bands at frequencies of 30 MHz, 160 MHz, 300 MHz and 450 MHz respectively. These graphs generally depict good elevation coverage from 0 to 180 degrees, with notches in the gain around 90 degrees.

During operation, the multi-band antenna may be positioned on a ground plane, for example on a surface of a vehicle. The feeds of the L-band and VHF/UHF band antenna are then coupled to a transceiver to transmit and receive signals via the multi-band antenna in frequencies of interest. The VHF/UHF signals for transmission via the multi-band antenna are multiplexed onto the VHF/UHF feed for transmission. The L band satellite signal is transmitted onto the L-band feed. The VHF signals on the VHF/UHF feed are radiated by the antenna along the electrical length of the antenna between the base and the chokes 130, 135. The UHF signals on the VHF/UHF feed are radiated by the antenna along the electrical length of the antenna between the chokes 105, 110 and 120, 125. The L-band signals traverse the length of the antenna structure and reach the L-band antenna where they are transmitted by the L-band antenna.

When receiving signals, the electrical length of the antenna between the base and the chokes 130, 135 receive signals and which are electrically coupled to the VHF/UHF feed that transverse the feed to the receiver which de-multiplexes the VHF signal from the UHF signal. UHF signals are received along the electrical length of the antenna between the chokes 105, 110 and 120, 125, are electrically coupled to the VHF/UHF feed and are demultiplexed from the VHF signals by a receiver. Similarly, L band signals are received by the L band antenna and coupled to the receiver via the L band feed.

Figure 6:
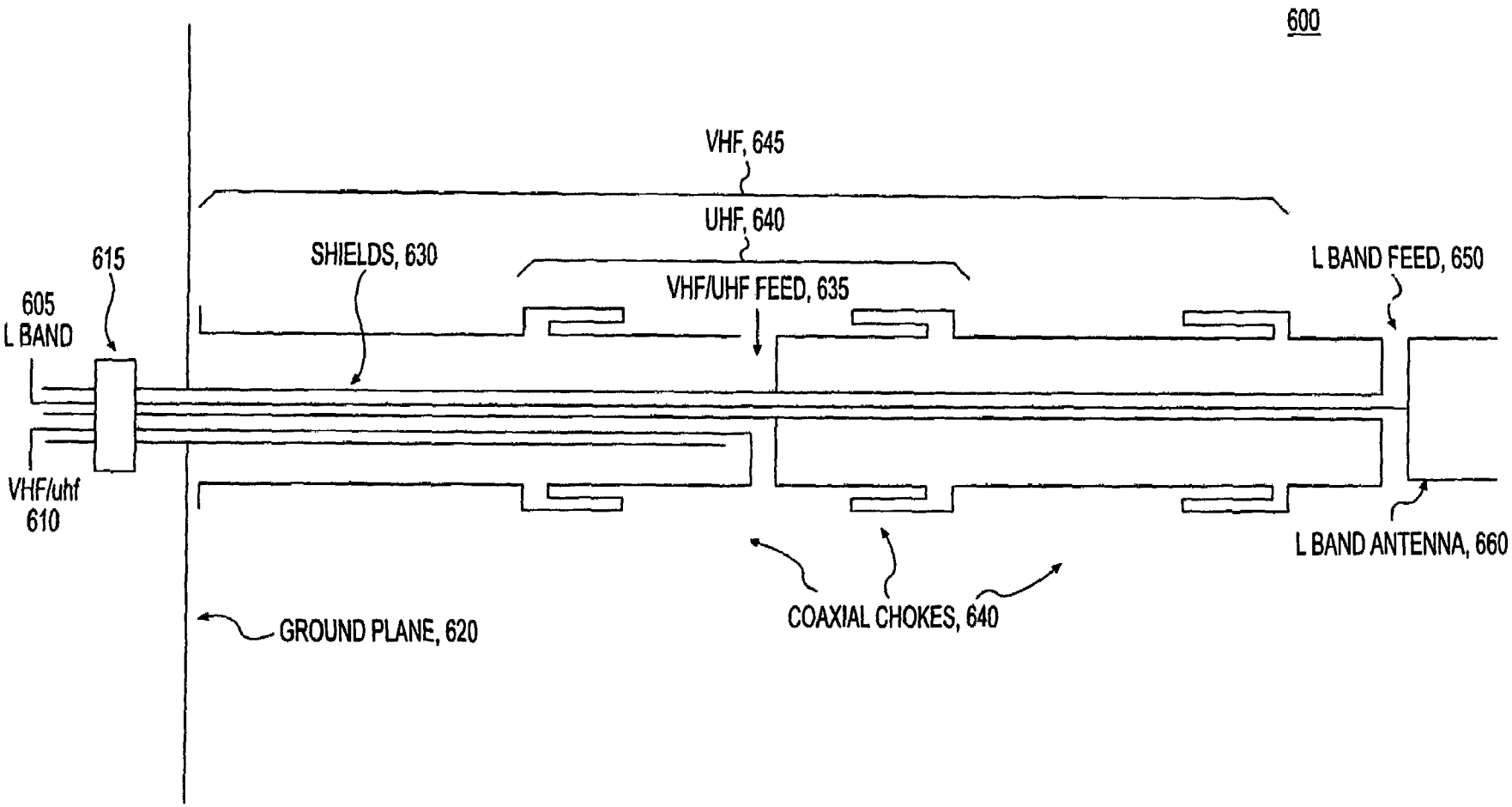
FIG. 6 depicts a coaxial antenna for multi band operation according to another embodiment of the present invention.

FIG. 6 depicts a multi-band feed antenna 600 according to another embodiment of the present invention. This embodiment is similar to the embodiment depicted in FIG. 1. Referring to FIG. 6, the antenna is a coaxial antenna that includes VHF and UHF portions 640 and 645 and a L band antenna 660. The antenna includes shielded conductors 605 and 610 that respectively are coupled to the antenna 600 at its base to allow the communication of signals between the antenna and transceiver equipment. The shielded conductors 605 and 610 may be any type of shielded conductor, including coaxial cable. The shielded conductors 605 and 610 may be wrapped around a ferrite loaded coil according to one embodiment of the invention as discussed above with reference to FIG. 1. The shields 630 of the conductors 605 and 610 may be electrically coupled together as shown. In addition, the central conductor of the VHF/UHF shielded conductor may be coupled as shown to the lower VHF/UHF portion of the antenna structure as shown, while the shields 630 may be coupled to the upper VHF/UHF portion of the antenna structure as shown. In this configuration, the VHF/UHF antenna feed is located in the approximate middle of the VHF/UHF antenna portions between the portion fed by the central conductors and the other portion fed by the conductor shields. The L band central conductor passes through the shields and is coupled at upper end of the antenna to a L band antenna 660. According to this embodiment, the ground plane 620 is coupled to the shields at the base. The coaxial chokes may be coaxial meanderline chokes as described above or any other choke element for confining frequencies of interest between the chokes lower chokes in one frequency band and between the base and the upper chokes in another frequency band, for example the UHF and VHF frequency bands according to a preferred embodiment of the invention. It will be understood, however, that the chokes for any embodiments may be adjusted to change the frequencies of interest for which the different portions of the antenna are effectively active.

Figure 7:
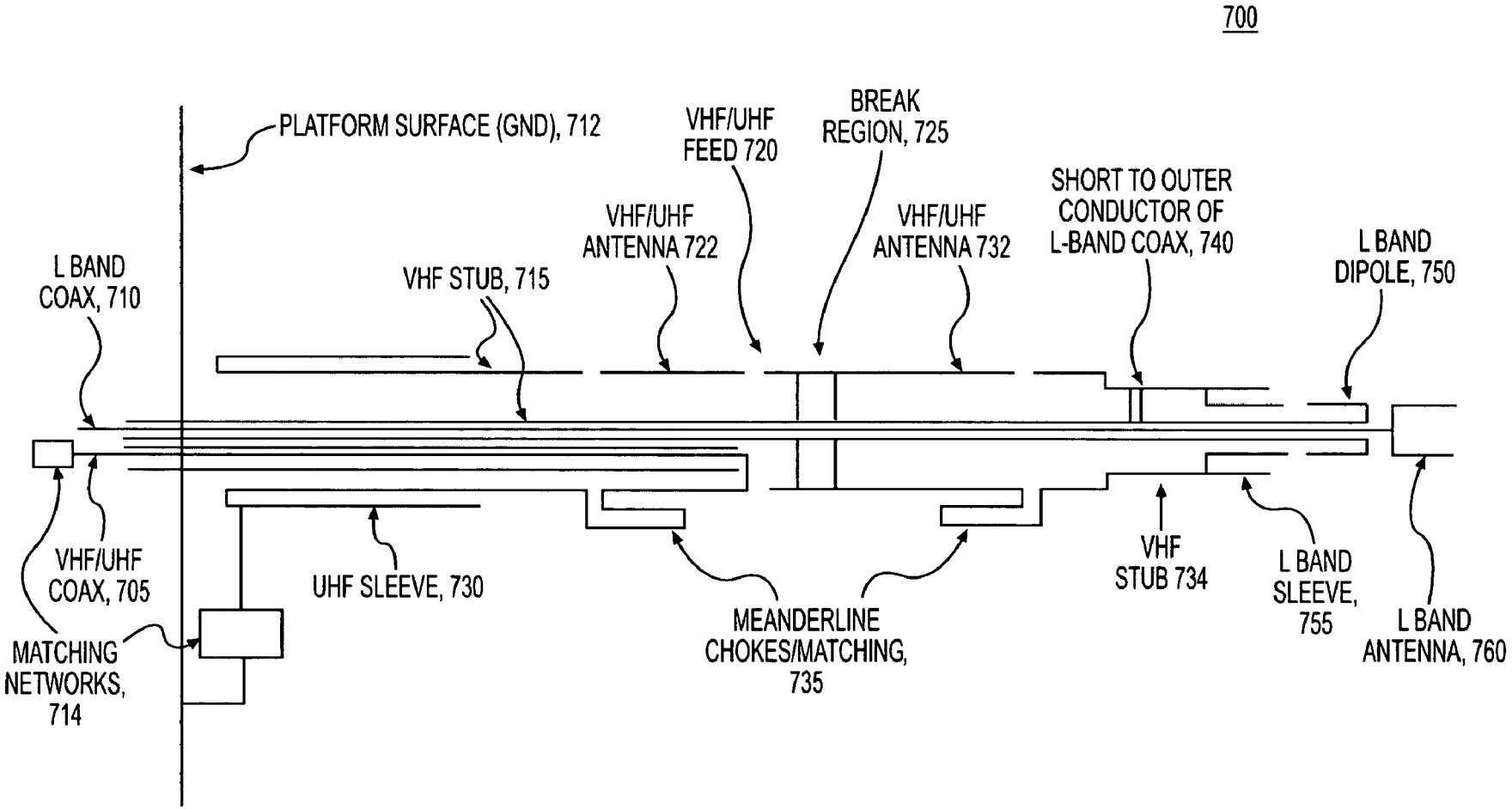
FIG. 7 depicts a coaxial antenna for multi band operation according to another embodiment of the present invention.

FIG. 7 depicts a multi-band antenna 700 according to another embodiment of the present invention. Referring to FIG. 7, the antenna 700 is a coaxial antenna with a base on the left side of the figure and an upper end at the right side of the figure. At the base of the antenna, signals are provided to and from the antenna 700 via a VHF/UHF shielded conductor 705 and via a L band shielded conductor 710. The antenna 700 of FIG. 7 may have the same overall dimensions as an antenna according to FIG. 1 or 6 and may operate in any number of frequency ranges, including the VHF, UHF and L band frequency ranges described above.

Similar to the antennas of FIG. 6, the shields of the L band and VHF/UHF conductors are coupled together. The shields may be further coupled to the VHF stub 715, which is coaxial and capacitively coupled to ground through short 740. The VHF/UHF central conductor is coupled to the VHF/UHF antenna 722, which is in turn coupled to the VHF stub 715 through a choke 735, which may be a meanderline choke or any other type choke as described above that provides the appropriate division between two frequency ranges, in a preferred case the VHF/UHF frequencies described above. In addition, a UHF sleeve 730 may be coupled to the base of the VHF stub. The UHF sleeve may be further coupled to the ground plane 712 through a matching network 714 that may have the same or approximately the same parameters as a matching network implemented as an input to the VHF/UHF conductors 705. In this configuration, the VHF/UHF feed 720 is approximately at the center of the antenna 700 as shown between the lower and upper portions of the antenna.

The upper portion of the antenna may include a break region 725. The break region is a region of the antenna that may be separated, and generally includes blind mate connectors and mating threading to allow upper and lower antenna portions to be screwed together to create both mechanical and electrical connections to permit, for example, the L band signals to pass through the break region. The shields from the conductors 705 and 710 are coupled to the upper VHF/UHF antenna portion 732, which are further coupled to an upper VHF stub 734 through a choke 735. The choke 735 matches the choke implemented in the lower portion of the antenna. In one embodiment, the meanderline chokes may include a cut off frequency at 225 MHz. This acts as a low pass filter. In addition, the outer conductor of the L band conductor may be shorted to the upper VHF stub 734 as shown. In addition, the at the upper end of the antenna 700, the L band conductor (and shields) passes the upper VHF stub and through L band sleeves 755. The shields of the L band conductor then form part of a L band dipole 750 at the upper end and the L band central conductor is coupled to an L band antenna 760 at the upper end of the antenna. Such a configuration may be implemented to realize a 96 inch coaxial antenna, in a preferred embodiment, that radiates in the frequency ranges identified above.

Figure 8:
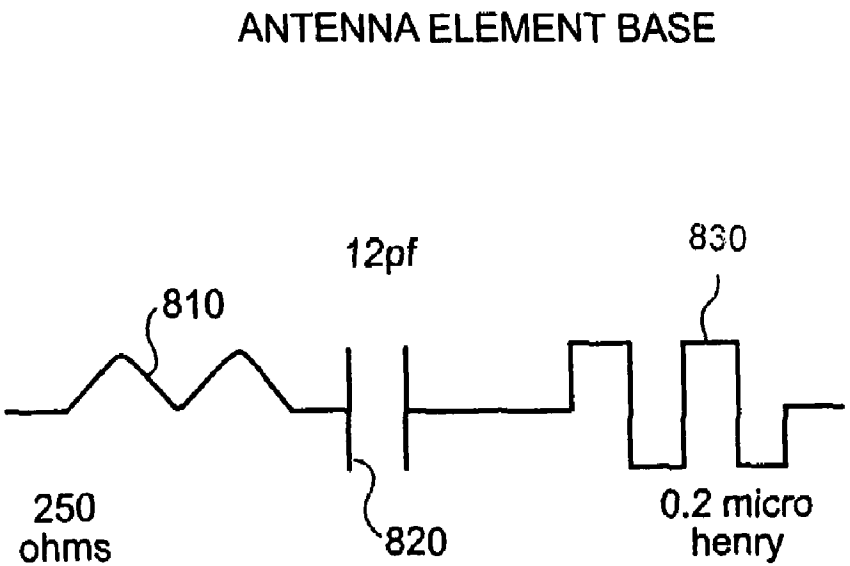
FIG. 8 depicts an illustrative matching network that may be implemented at the antenna base to couple the UHF sleeve to, for example, a ground plane.

FIG. 8 depicts an illustrative matching network that may be implemented at the antenna base to couple the UHF (or other frequency of interest) sleeve to, for example, a ground plane. Such a network may include, for example, a 250 ohm resistive element 810 that is series coupled to a 12 pf capacitor element 820 and a 0.2 micro henry inductor element 830.

Figure 9:
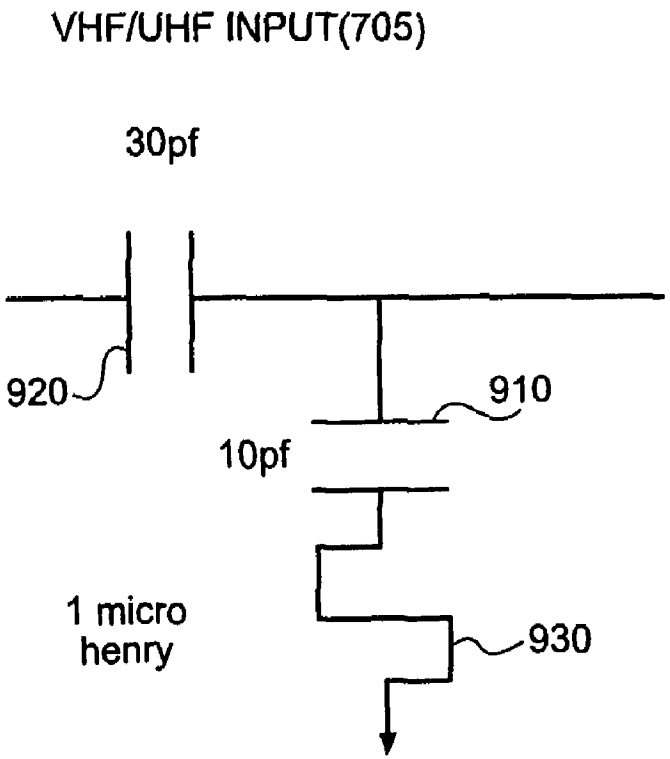
FIG. 9 depicts an illustrative matching network that may be implemented at the VHF/UHF signal input.

FIG. 9 depicts an illustrative matching network that may be implemented at the VHF/UHF signal input (or input for signals at other frequencies of interest) to facilitate coupling to a VHF/UHF conductor within the antenna. Referring to FIG. 9, the network includes a 20 pf capacitor element 920 through which the VHF/UHF signals are carried. In addition, a 10 pf capacitor element 910 and a 1 micro henry inductor element 930 may be coupled in parallel to ground.

Figure 10:
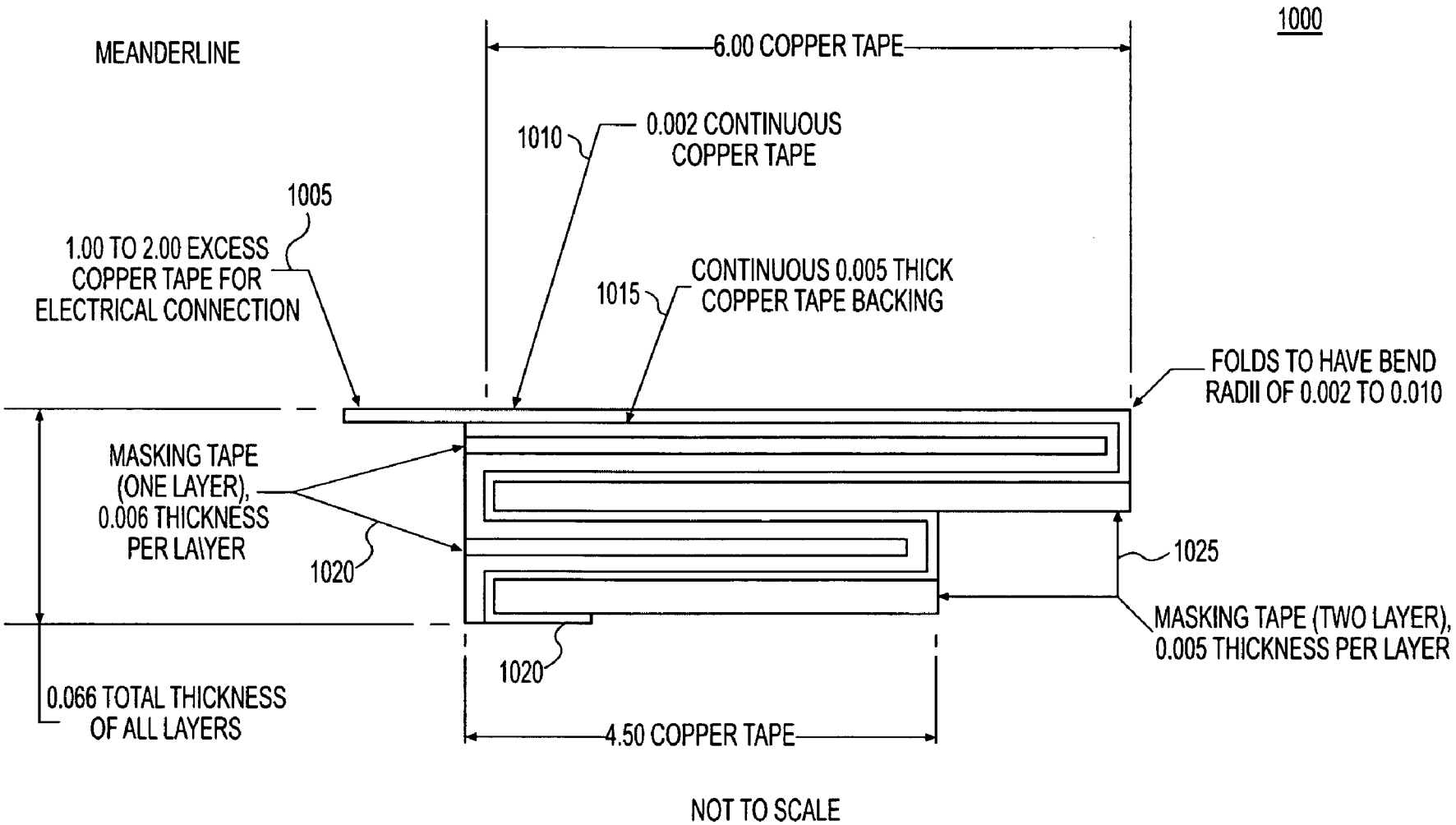
FIG. 10 depicts an illustrative meanderline structure according to an embodiment of the invention.

FIG. 10 depicts a meanderline 1000 that may be used to implement chokes according to an embodiment of the invention. Referring to FIG. 10, the meanderline 1000 may be implemented as a folded metal strip 1010 that may be constructed of an electrically conductive material, preferably copper. However, any other conductive material suitable for radiating electromagnetic energy at frequencies of interest may be used. The metal strip 1010 may include an excel portion 1005 used to connect the metal strip 1010 to the antenna. The point of connection of the meanderline 1000 to the antenna structure is chosen to create antenna segments that operate at different frequencies of interest as described hereinabove.

According to one embodiment of the invention, the metal strip 1010 includes four bends or folds that define the meanderline. Each fold of the metal strip 1010 creates a strip section that is substantially parallel to the previous section 1010 and four strips sections are created along the length of the metal strip 1010 as shown. Different sections of the metal strip 1100 are electrically isolated from each other by interposing a dielectric between the folds of the metal strip 1010. This may be done in various ways, including by using an appropriate dielectric to fill in the spaces between metal strip sections. According to one embodiment of the invention, the metal strip may be implemented as a tape, having a thickness of 0.002 inches with a dielectric backing 1015 that is 0.005 inches thick. The dielectric backing may form a portion of the dielectric that fills the space between adjacent sections of the metal strip 1010. An additional dielectric layer may be formed by, for example, a dielectric masking tape of a different thickness. According to one embodiment of the invention, therefore, a dielectric tape 1020 having a 0.006 inch thickness may be used to separate, together with the dielectric backing 1015, sections of the metal strip. However, it will be understood that adjacent sections of the metal strip 1010 may be filled by a dielectric including any convenient technique for applying dielectrics or dielectric coatings.

Moreover, when the folded metal strip includes a backing, in sections where the fold causes two surfaces of the metal strip to be run adjacent to each other, a dielectric tape 1025 may be inserted into this section. The tape may be thicker than the tape 1020 or thinner. According to one embodiment of the invention, the dielectric tape 1025 may be 0.008 inches thick.

According to the embodiment illustrated in FIG. 10, two sections of the metal strip are approximately 6 inches long, two others are approximately 4.5 inches long and a fifth section is approximately 1 inch long. In addition, the excess portion of the metal strip 1005 is approximately 1 inch long. The metal strip may be 0.5 inches wide and may be implemented as a strip or as a concentric cylinder about part of all of the antenna axis. According to one embodiment, the meanderline of FIG. 10 may be implemented as a printed circuit variable impedance structure with the dimensions shown and as further described in U.S. Pat. No. 6,504,508 and incorporated by reference herein, which is hereby incorporated by reference herein. The dimensions of the meanderline shown are optimized to act as a choke to frequencies 225 Mhz to 450 Mhz. It will be understood by those having ordinary skill in the art that one could change these values by decreasing the strip lengths and increasing the frequency cutoff or increasing the strip lengths to decrease the frequency cutoff. In addition the widths of the meanderlines and the thickness of dielectric layers may be increased or decreased to change the impedance of the meanderline and the characteristic behavior of the meanderline structure over different frequency ranges. In general, the thickness of the meanderlines and dielectrics are chosen with an impedance characteristic of the antenna structure in mind to match the desired impedance of the antenna or otherwise to reach an impedance value that is within an acceptable range of the antenna impedance or desired value.

In addition to the embodiments of meanderlines described above, the chokes may be implemented using a variety of different meanderline techniques, including those disclosed in U.S. Pat. No. 5,790,080 and incorporated by reference herein. For example, the chokes may be implemented using juxtaposed folded meanderlines as described U.S. Pat. No. 6,313,716 and incorporated by reference herein. Such meanderlines may be vertically integrated and layered onto a surface of a multiband antenna to form the chokes as shown and described in this patent.

The meanderline may provide self shielding as shown in U.S. Pat. No. 6,894,656 and incorporated by reference herein. Meanderlines may also implemented as a stagger tuned meanderline loaded antenna as shown in U.S. Pat. No. 6,791,502 and incorporated by reference herein. The meanderline may also be implemented as a multilayer meanderline for a wideband antenna as shown in U.S. Pat. No. 6,373,440 and incorporated by reference herein. In addition, the meanderline may use an activation controlled variable impedance transmission lines as described in U.S. Pat. No. 6,774,745 and incorporated by reference herein to actively tune a multiband antenna to, for example, frequencies below 20 Mhz.

Figure 11A:
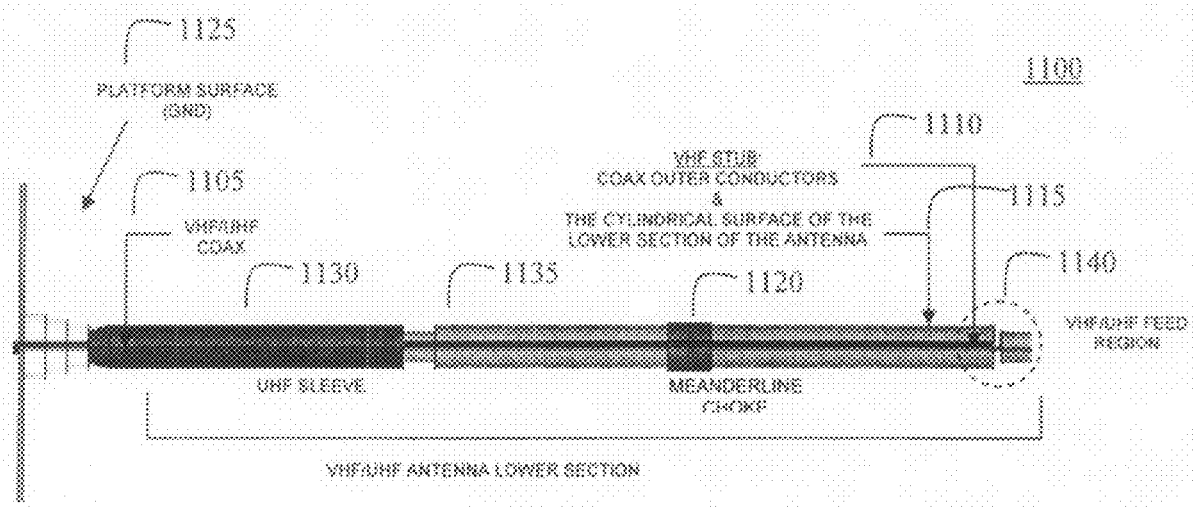
FIGS. 11A and 11B depict an illustrative feed arrangement according to an embodiment of the invention.
Figure 11B:
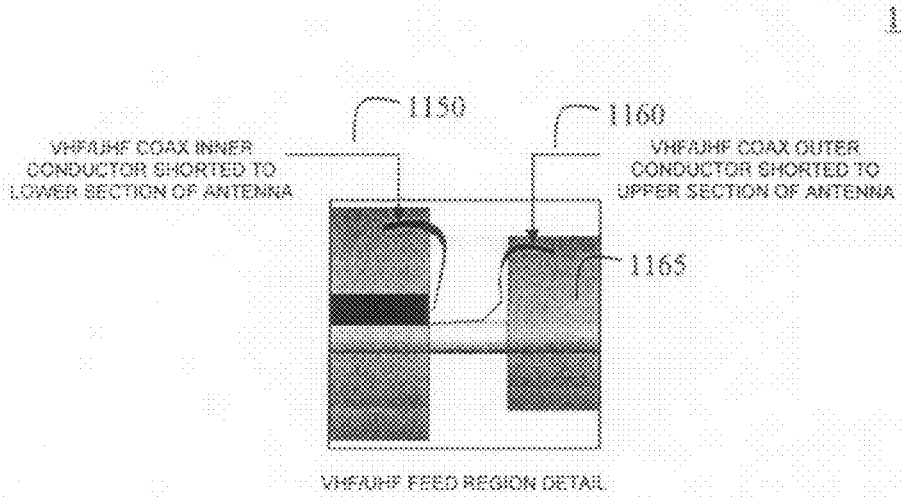

FIGS. 11A and 11B depict an embodiment of a feed connection of the VHF/UHF antenna feed to an antenna feed point of the VHF/UHF antenna. According to one embodiment of the invention, the feed point of the VHF/UHF antenna is at a common point on the VHF/UHF antenna and in addition, the feed may be made through a common VHF/UHF coaxial cable 1105 or other conductor routed within the antenna housing. Referring to FIG. 11A, the feed point and the lower section of the VHF!UHF antenna portion of the antenna 1100 is shown, including the feed point of the VHF/UHF portion of the antenna 1100. The antenna 1100 may be physically and electrically secured to a platform surface 1125 at a ground potential. The antenna may include a UHF sleeve 1130 and a VHF sleeve 135 over the cylindrical (or other) surface 1115 of the lower section of the antenna 1100 with a meanderline choke 1120 positioned along the VHF sleeve and a VHF stub 1110 at the feed region. One embodiment of a feed portion of the antenna 1140 is shown in FIG. 11B.

Referring to FIG. 11B, the VHF/UHF coaxial cable 1105 is shown coupled at the feed point so that the inner conductor 1150 of the coaxial cable is shorted to the cylindrical surface of the lower section of the antenna 1100 and the outer conductor 1160 of the coaxial cable is shorted to the cylindrical surface of the upper section 1165 of the antenna 1100. It is common practice when feeding a dipole to connect the inner conductor of the coax to the top section of the antenna and to connect the outer conductor of the coax to the lower section of the dipole.

According to one embodiment of the invention, the MBA feed for the VHF/UHF antenna is similar to a dipole in structure, but differs in that it uses a "reverse excitation" feeding scheme where the inner conductor of the coax is connected to the lower section of the antenna while the outer conductor of the coax is connected to the upper section of the antenna, as shown in FIGS. 11A and 11B. This feed approach creates a parallel connected matching stub which is comprised of the outer conductor of the VHF/UHF feed coax and the lower section of the antenna element (cylindrical antenna surface) and facilitates operation at lower frequencies.

While particular embodiments of the invention have been shown and described, it will be understood that changes may be made to those embodiments without departing from the spirit and scope of the invention. For example, while particular frequency ranges and VHF, UHF and L band frequencies have been described, it will be understood that frequencies outside of these frequency ranges may be implemented according to the present invention.

What is claimed is:

1. A coaxial antenna capable of operating in at least two different frequency ranges, comprising:

radiating elements capable of operating in a first frequency range of interest;

chokes that limit the operating efficiency of at least portions of the radiating elements at the second frequency range;

a sleeve coupled to the radiating elements; and at least two matching networks, a first one of the matching network coupled between the sleeve and a ground potential and the second one of the matching networks coupled to an antenna feed capable of coupling signals at the first and second frequency ranges to the radiating elements;

wherein the choked portions of the radiating elements are not capable of efficient operation at the second frequency range of interest; and wherein at least one choke is implemented as a meanderline.

2. The antenna according to claim 1, wherein the meanderline is implemented using at least two layers of a meanderline.

3. The antenna according to claim 1, wherein the meanderline is implemented using at least four layers of a meanderline.

4. The antenna according to claim 2, wherein the meanderline is manufactured on a printed circuit board.

5. The antenna according to claim 1, wherein the meanderline is self shielding.

6. The antenna according to claim 1, wherein the meanderline is not self shielding.

7. The antenna according to claim 1, wherein the radiating elements are supplied using a coaxial cable and a reverse excitation feed.

8. The coaxial antenna according to claim 1, wherein the first frequency range is lower than the second frequency range.

9. The coaxial antenna according to claim 1, wherein the first frequency range is higher than the second frequency range.

10. The coaxial antenna according to claim 1, wherein the antenna is capable of use for at least one of transmitting and receiving at each of the frequency ranges.

11. The coaxial antenna according to claim 1, wherein the communication with the antenna at the first and second frequency ranges occurs through a common conductor.

12. The coaxial antenna according to claim 11, wherein the common conductor forms at least part of the radiating elements capable of operating at the first and second frequency ranges.

13. The coaxial antenna according to claim 11, wherein first and second frequency ranges comprise frequency ranges in the UHF and VHF frequency bands, respectively.

14. The coaxial antenna according to claim 11, wherein the common conductor is a shielded conductor.

15. The coaxial antenna according to claim 11, wherein the common conductor is a coaxial cable.

16. The coaxial antenna according to claim 11, further comprising a second conductor capable of carrying a third frequency range; and wherein the antenna includes a base end and a top end, the common conductor and second conductor enter the base and the second conductor is coupled to an antenna element at the top end of the antenna.

17. The coaxial antenna according to claim 16, wherein the third frequency range is associated with the L band frequency range.

18. The coaxial antenna according to claim 16, wherein the antenna element at the top comprises a satellite antenna.

19. A coaxial antenna capable of operating at in at least two different frequency ranges, comprising:

radiating elements capable of operating in a first frequency range of interest;

chokes that limit the operating efficiency of at least portions of the radiating elements at the second frequency range;

a sleeve coupled to the radiating elements;

at least two matching networks, a first one of the matching network coupled between the sleeve and a ground potential and the second one of the matching networks coupled to an antenna feed capable of coupling signals at the first and second frequency ranges to the radiating elements; and a common conductor coupled to the antenna feed having a reverse excitation coupling; and wherein the communication with the antenna at the first and second frequency ranges occurs through the common conductor, wherein the choked portions of the radiating elements are not capable of efficient operation at the second frequency range of interest, and wherein at least one choke is implemented as a meanderline.

20. The antenna according to claim 19, wherein the meanderline is implemented as at least of the following: a multilayered meanderline, a printed circuit board, a self shielded meanderline.

21. The antenna according to claim 19, wherein the first and second frequency ranges comprise frequency ranges in the UHF and VHF frequency bands, respectively.

22. The coaxial antenna according to claim 21, further comprising a second conductor capable of carrying a third frequency range; and wherein the antenna includes a base end and a top end, the common conductor and second conductor enter the base and the second conductor is coupled to an antenna element at the top end of the antenna.

23. The coaxial antenna according to claim 22, wherein the third frequency range is associated with the L band frequency range.

* * * * *